US009112251B2

(12) United States Patent
Fu

(10) Patent No.: US 9,112,251 B2
(45) Date of Patent: Aug. 18, 2015

(54) MICROWAVE RESONANT CAVITY

(71) Applicant: MICROELECTRONICS TECHNOLOGY, INC., Hsinchu (TW)

(72) Inventor: Wen Chi Fu, Beipu Township (TW)

(73) Assignee: Microelectronics Technology, Inc., Hsinchu (TW)

( * ) Notice: Subject to any disclaimer, the term of this patent is extended or adjusted under 35 U.S.C. 154(b) by 0 days.

(21) Appl. No.: 13/966,930

(22) Filed: Aug. 14, 2013

(65) Prior Publication Data

US 2015/0048905 A1 Feb. 19, 2015

(51) Int. Cl.
*H01P 7/06* (2006.01)
*H01P 1/207* (2006.01)

(52) U.S. Cl.
CPC . *H01P 7/06* (2013.01); *H01P 1/207* (2013.01)

(58) Field of Classification Search
None
See application file for complete search history.

(56) References Cited

U.S. PATENT DOCUMENTS 3,103,609 A 9/1963 Zitelli
4,862,111 A * 8/1989 Mettoudi et al. ..... 331/96
5,422,541 A 6/1995 Tsuida
5,621,367 A * 4/1997 Pollanen ..... 333/224
7,227,434 B2 * 6/2007 Haraldsson et al. ..... 333/232
7,728,700 B2 * 6/2010 Sieber et al. ..... 333/206
2004/0263289 A1 * 12/2004 Cobb ..... 333/231

FOREIGN PATENT DOCUMENTS

EP 0125450 11/1984

OTHER PUBLICATIONS

Office Action issued in EP 13180725.7 dated Nov. 19, 2014 (3 pages total).
Office Action issued May 21, 2015 in corresponding Chinese patent application, 6 pages total (English language summary translation provided).

* cited by examiner

*Primary Examiner* — Lincoln Donovan
*Assistant Examiner* — Terry L Englund
(74) *Attorney, Agent, or Firm* — Hamre, Schumann, Mueller & Larson, P.C.

(57) ABSTRACT

A microwave resonant cavity includes a conductive shell with a screw hole having first threads and a screw having second threads configured to engage with the screw hole. The conductive shell defines a volume, the screw extends into the volume, the microwave resonant cavity has a resonant frequency, and the movement of the screw changes the resonant frequency. The first threads have a first pitch, and at least a portion of the second threads has a second pitch different from the first pitch.

14 Claims, 8 Drawing Sheets

MICROWAVE RESONANT CAVITY

TECHNICAL FIELD

The present disclosure relates to a microwave resonant cavity, and more particularly, to a microwave resonant cavity with a screw hole and a screw with threads of different pitches.

DISCUSSION OF THE BACKGROUND

Microwave and radio frequency (RF) filters are common components of communication devices. Both transmitters and receivers use filters for rejection of signals in the unwanted frequency bands. A major application of such filters is in cellular personal communications services (PCS) phones. The most commonly used filter for cellular PCS applications is the coaxial ceramic type in which several coaxial ceramic resonators with very high relative dielectric constants are coupled to each other. These filters are often installed on top of circuit boards and substantially increase the height of the board thickness. As a result, such filters are one of the components that restrict the implementation of thin cell/PCS phone designs.

A resonant cavity is a device having an enclosed volume bounded by electrically conductive surfaces and in which oscillating electromagnetic fields are sustainable. For example, resonant cavities may be used as filters and have excellent power handling capability and low energy losses. Several resonant cavities may be coupled together to achieve sophisticated frequency selective behavior.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY

One aspect of the present disclosure provides a microwave resonant cavity with a screw hole having a first pitch and a screw having a second pitch different from the first pitch.

A microwave resonant cavity according to one embodiment of the present disclosure comprises: a conductive shell defining a volume, wherein the conductive shell includes a screw hole having first threads; a screw having second threads configured to engage with the screw hole, wherein the screw extends into the volume, the microwave resonant cavity has a resonant frequency, and the movement of the screw changes the resonant frequency; wherein the first threads have a first pitch, and at least a portion of the second threads has a second pitch different from the first pitch.

A microwave resonant cavity according to another embodiment of the present disclosure comprises: a conductive shell defining a volume, wherein the conductive shell includes a screw hole having first threads; a screw having second threads configured to engage with the screw hole, wherein the screw extends into the volume; and wherein the microwave resonant cavity has a resonant frequency, and the movement of the screw changes the resonant frequency; wherein the first threads have a substantially constant pitch, and at least a portion of the second threads has a gradually changed pitch.

The resonant frequency of the microwave resonant cavity can be adjusted by changing the extending position of the screw into the volume, and the screw can be firmly fixed in the screw hole after the adjustment of the resonant frequency is completed due to the design of different pitches between the screw hole and the screw. As a result, the resonant frequency of the microwave resonant cavity will be maintained at the desired value.

The foregoing has outlined rather broadly the features and technical advantages of the present disclosure in order that the detailed description of the disclosure that follows may be better understood. Additional features and advantages of the disclosure will be described hereinafter, which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

The present disclosure is directed to a microwave resonant cavity with a screw hole and a screw with threads of different pitches. In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
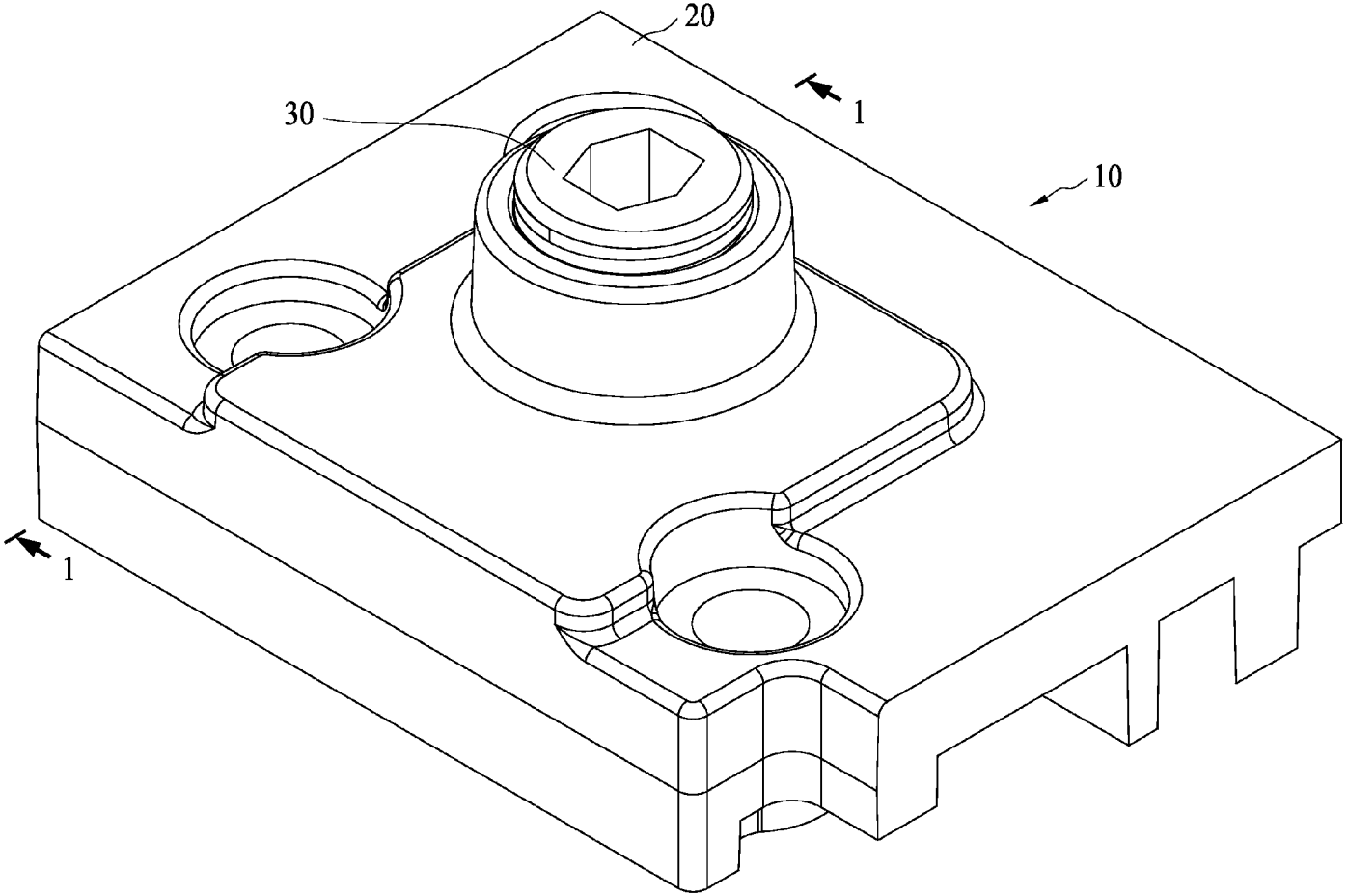
FIG. 1 illustrates an assembled view of a microwave resonant cavity according to one embodiment of the present disclosure.
Figure 2:
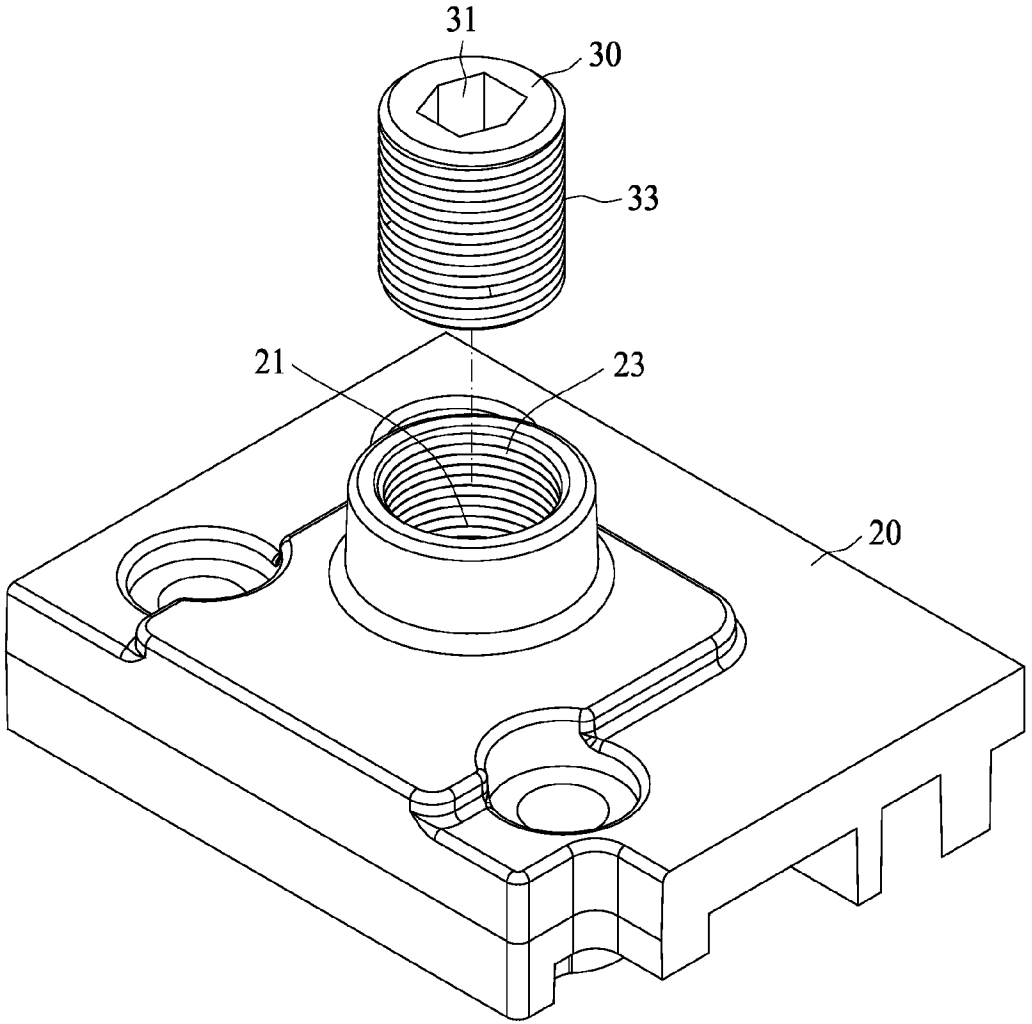
FIG. 2 illustrates a disassembled view of the microwave resonant cavity shown in FIG. 1.
Figure 3:
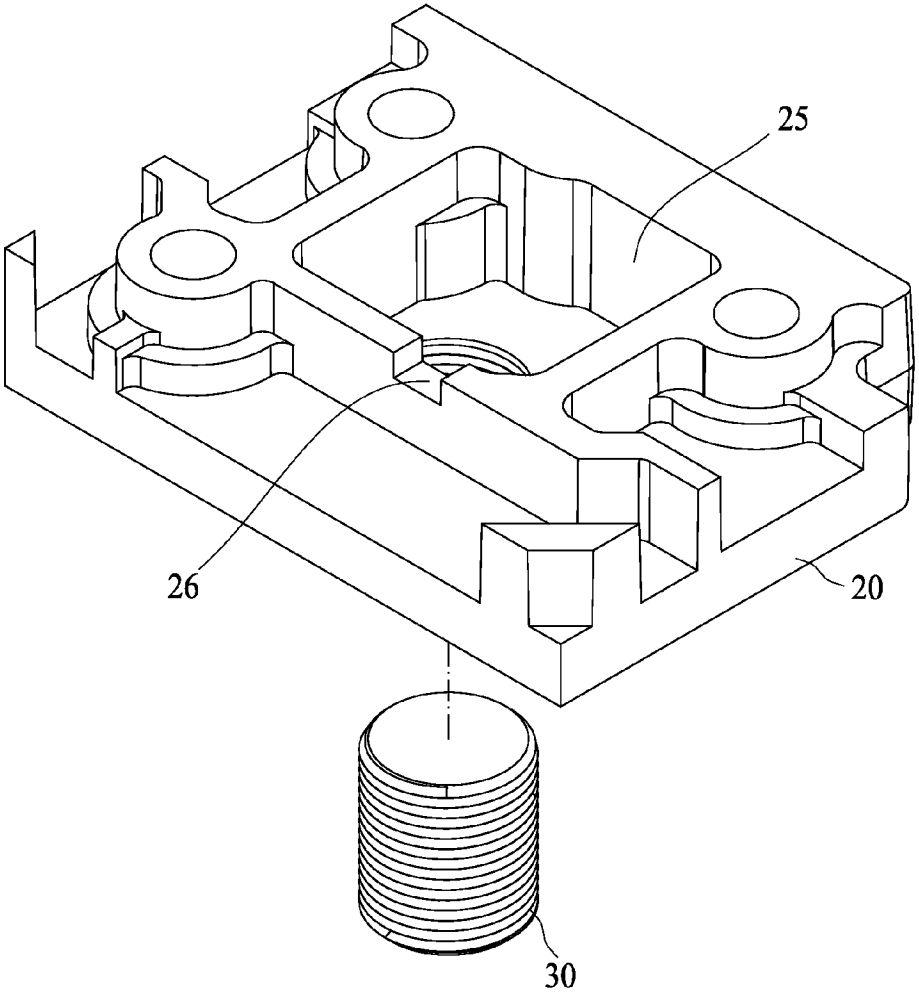
FIG. 3 illustrates an upside-down view of the microwave resonant cavity shown in FIG. 2.

FIG. 1 illustrates an assembled view of a microwave resonant cavity 10 according to one embodiment of the present disclosure, FIG. 2 illustrates a disassembled view of the microwave resonant cavity 10 shown in FIG. 1, and FIG. 3 illustrates an upside-down view of the microwave resonant cavity 10 shown in FIG. 2. In one embodiment of the present disclosure, the microwave resonant cavity 10 comprises a conductive shell 20 with a screw hole 21 having first threads 23 and a screw 30 having second threads 33 configured to engage with the screw hole 21.

Figure 4:
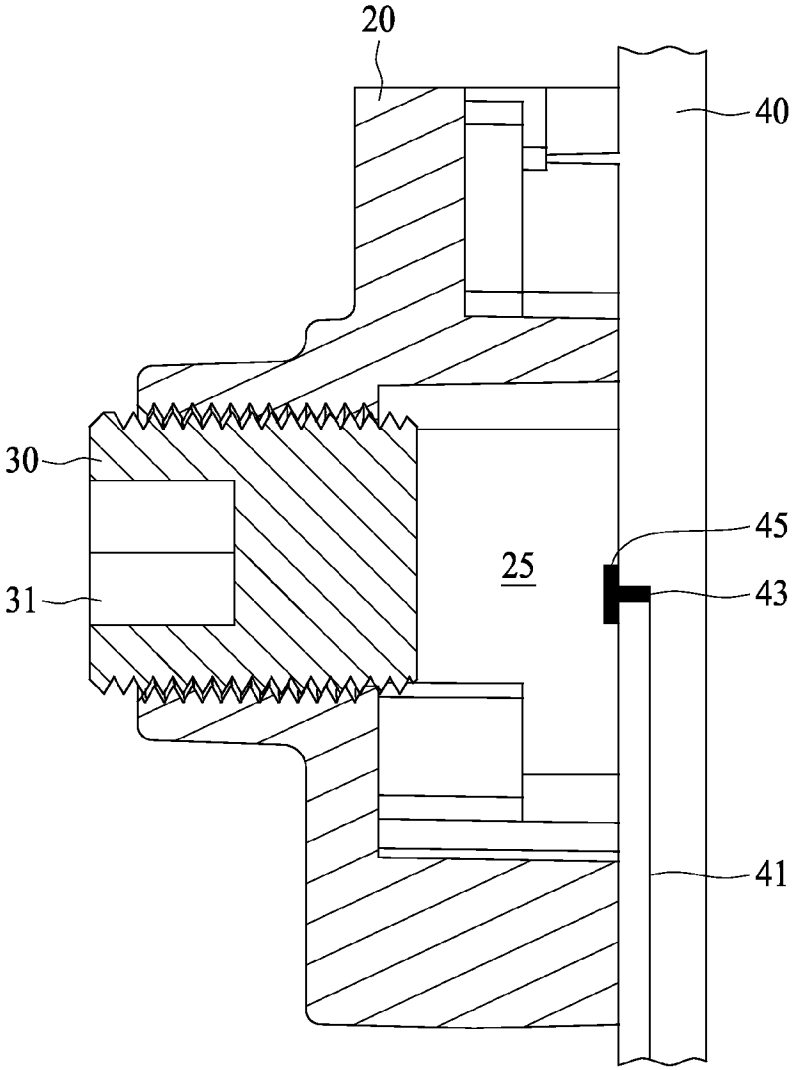
FIG. 4 illustrates a cross-sectional view of the microwave resonant cavity 10 along a section line 1-1 in FIG. 1.

FIG. 4 illustrates a cross-sectional view of the microwave resonant cavity 10 along a section line 1-1 in FIG. 1. Referring to FIG. 1, FIG. 3 and FIG. 4, in one embodiment of the present disclosure, the conductive shell 20 defines a volume 25, the screw 30 extends into the volume 25, and the microwave resonant cavity 10 has a resonant frequency depending on the position of the screw 30. In other words, the movement of the screw 30 changes the resonant frequency. In one embodiment of the present disclosure, the conductive shell 20 includes a notch 26 configured to couple microwave energy into or out of the volume 25, as shown in FIG. 3.

In one embodiment of the present disclosure, the screw 30 includes a depression 31 on one end to accommodate a tool such as a screw driver for driving the screw 30 into the volume 25 to adjust the resonant frequency of the microwave resonant cavity 10. In one embodiment of the present disclosure, the conductive shell 20 has a first hardness, and the screw 30 has a second hardness greater than the first hardness, such that the first threads 23 of the conductive shell 20 will be deformed by the second threads 33 of the screw 20. As a result, the deformed first threads 23 of the conductive shell 20 will lock up the screw 20 at a desired position, i.e., the screw 20 can be firmly fixed in the screw hole 21, and the resonant frequency of the microwave resonant cavity 10 will be kept at a desired frequency.

In one embodiment of the present disclosure, the microwave resonant cavity 10 further comprises a printed circuit board 40 having a transmission line 41, wherein the conductive shell 20 is mounted on the printed circuit board 40. The electromagnetic properties of the resonant, air-filled resonant cavity 10 are dependent on the exact dimensions of the effective length of the screw 30 and its distance from the external wall of the cavity, and the capacitive gap between the screw 30 and the external metalized surface of the printed circuit board 40 that forms a part of the resonant cavity 10.

The microwave signal is considered to be guided to the resonant cavity 10 through the embedded waveguide/transmission line 41, which can be implemented, for example, in either microstrip or stripline technology. When the microwave signal reaches the end of the feeding transmission line 41, it is guided through a vertical via post (or an array of via posts) 43 to a metalized feeding pad 45 located inside the volume 25.

Figure 5:
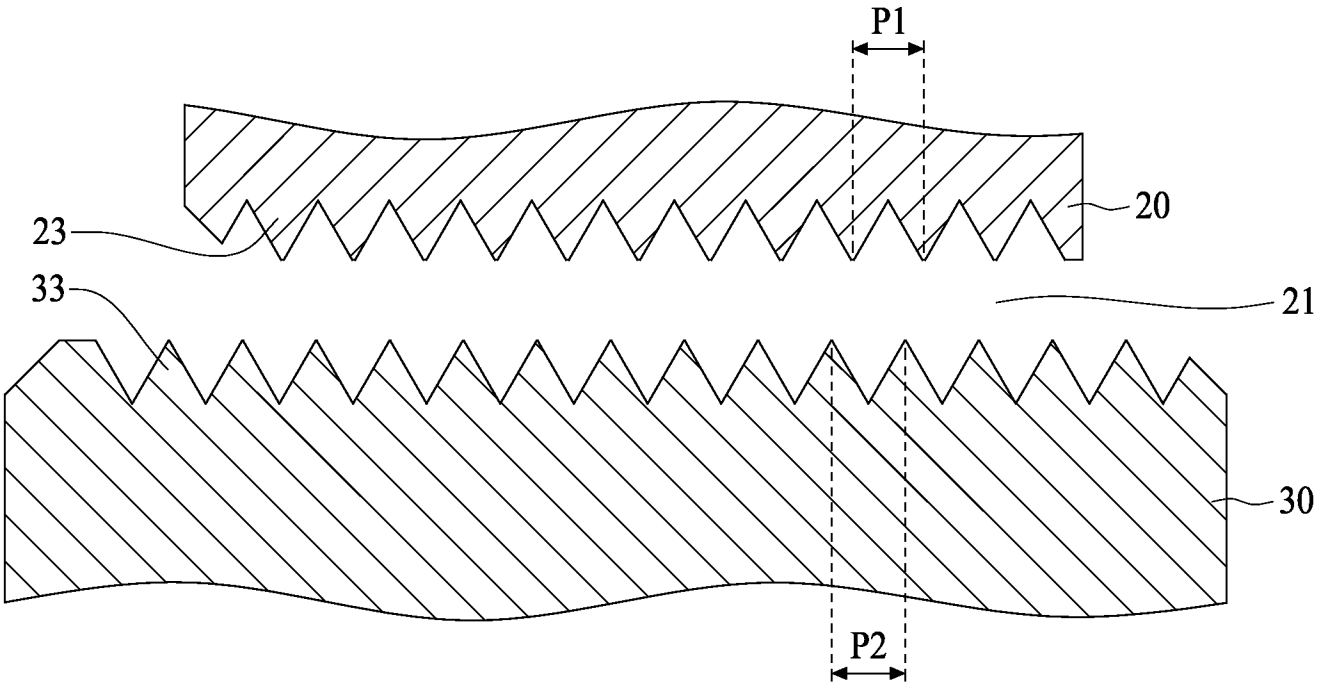
FIG. 5. is a close-up cross-sectional view of the conductive shell and the screw according to one embodiment of the present disclosure.

FIG. 5. is a close-up cross-sectional view of the conductive shell 20 and the screw 30 according to one embodiment of the present disclosure. In one embodiment of the present disclosure, the first threads 23 have a first pitch P1, and at least a portion of the second threads 33 has a second pitch P2 different from the first pitch P1. In a preferred embodiment of the present disclosure, the second pitch P2 is substantially larger than the first pitch P1.

Figure 6:
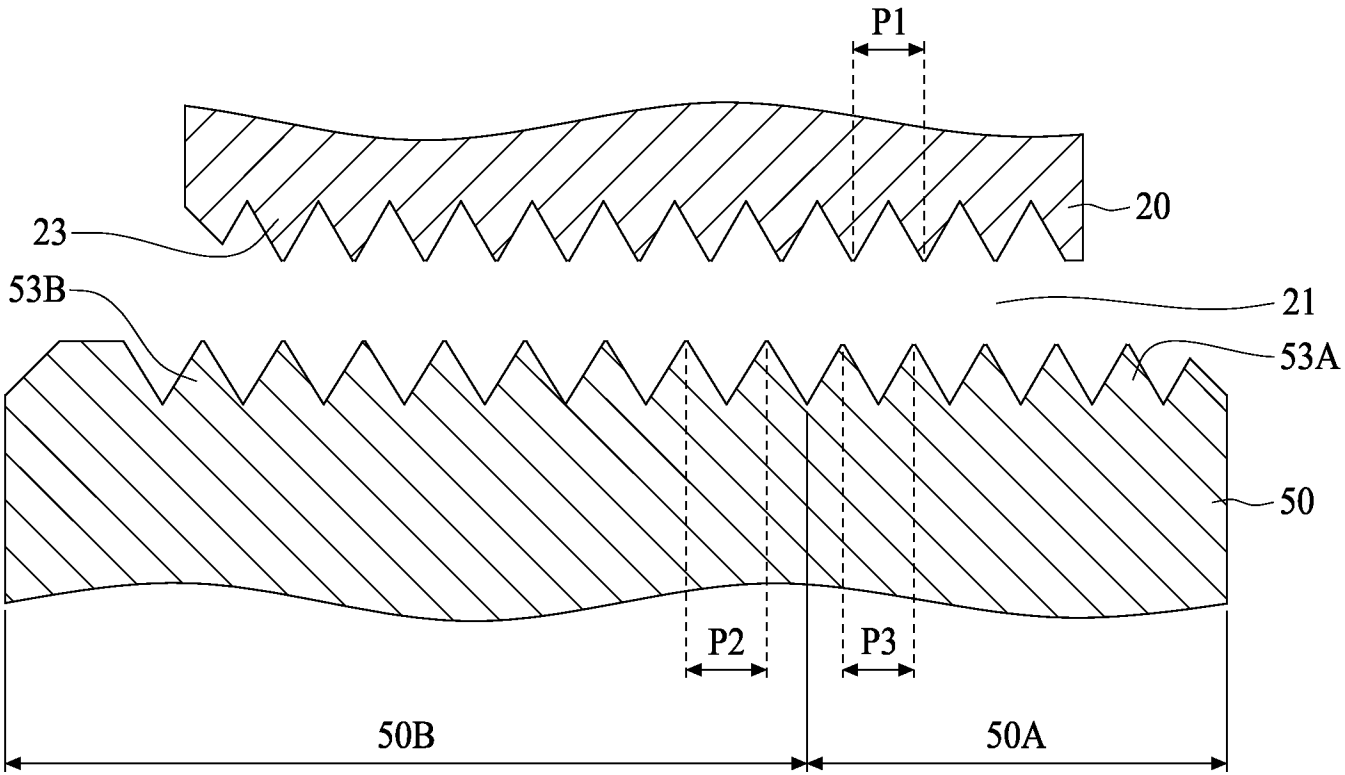
FIG. 6. is a close-up cross-sectional view of the conductive shell and a screw according to another embodiment of the present disclosure.

FIG. 6. is a close-up cross-sectional view of the conductive shell 20 and a screw 50 according to another embodiment of the present disclosure. In one embodiment of the present disclosure, the screw 50 has a front portion 50A having third threads 53A and a back portion 50B having second threads 53B, wherein the second threads 53B have a second pitch P2 and the third threads 53A have a third pitch P3 different from the second pitch P2. In one embodiment of the present disclosure, the third pitch P3 can be either larger than or equal to the second pitch P2.

In one preferred embodiment of the present disclosure, the third pitch P3 of the third threads 53A in the front portion 50A is substantially the same as the first pitch P1 of the first threads 23 in the conductive shell 20, such that the screw 50 can be easily moved into the screw hole 21 of the conductive shell 20 when the front portion 50A begins to engage with the screw hole 21. After the front portion 50A is moved into the screw hole 21, the back portion 50B of the screw 50 starts to engage with the screw hole 21, and the screw 50 can be firmly fixed in the screw hole 21 by using the different pitch design between the first threads 23 and second threads 53B.

Figure 7:
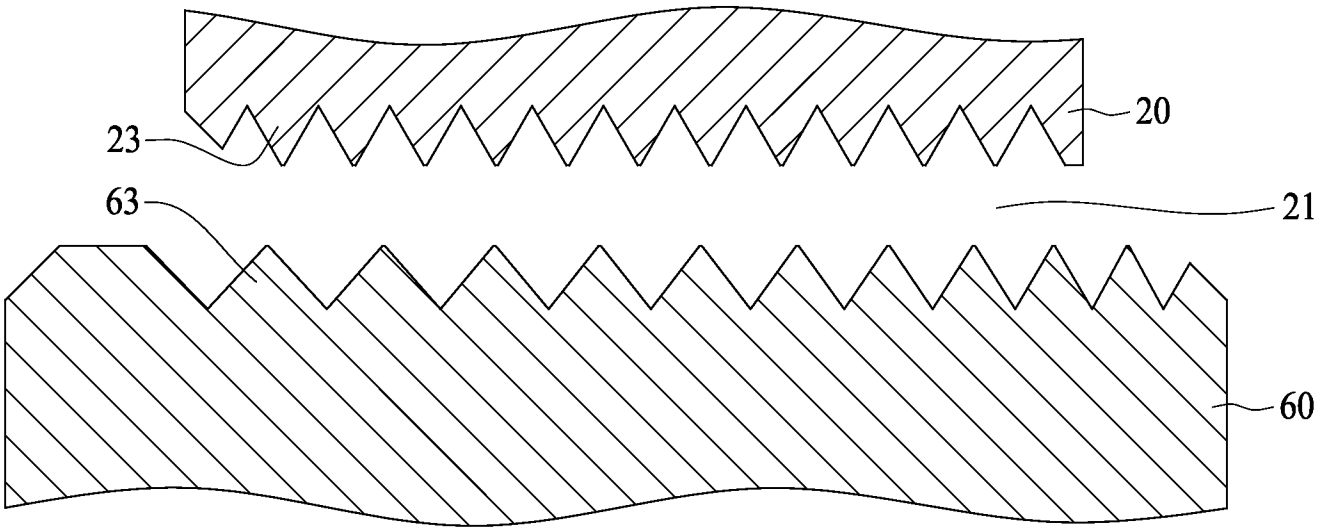
FIG. 7. is a close-up cross-sectional view of the conductive shell and a screw according to another embodiment of the present disclosure.

FIG. 7. is a close-up cross-sectional view of the conductive shell 20 and the screw 60 according to another embodiment of the present disclosure. In one embodiment of the present disclosure, the screw 60 has second threads 63 with a gradually changed pitch, and the first threads 23 of the conductive shell 20 have a substantially constant pitch. In a preferred embodiment of the present disclosure, the pitch of the second threads 63 at a front portion of the screw 60 is substantially the same as the pitch of the first threads 23 in the conductive shell 20, such that the screw 60 can be easily moved into the screw hole 21 of the conductive shell 20 when the front portion begins to engage with the screw hole 21. After the front portion is moved into the screw hole 21, the threads 63 with increasing pitch start to engage with the screw hole 21 and the screw 60 can be firmly fixed in the screw hole 21 by using the increasing pitch design of second threads 63.

Figure 8:
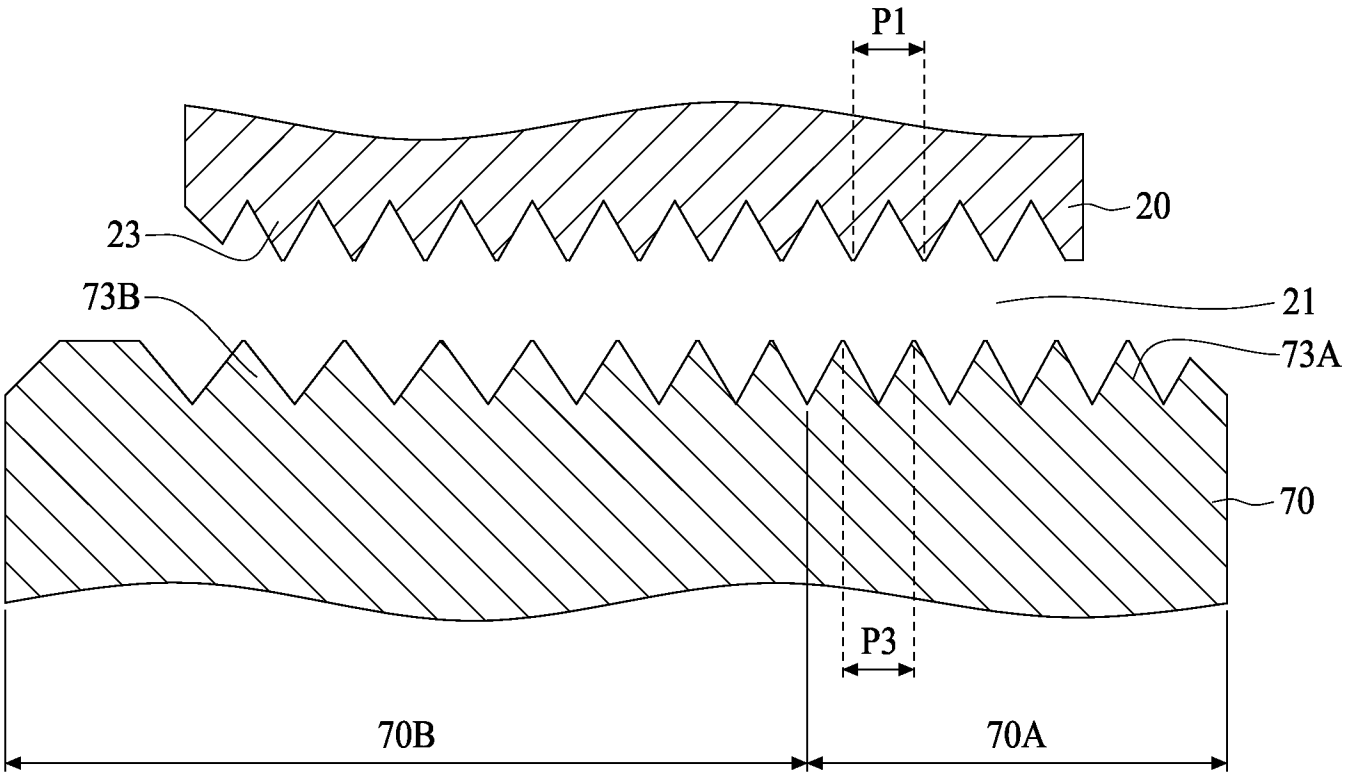
FIG. 8. is a close-up cross-sectional view of the conductive shell and a screw according to another embodiment of the present disclosure.

FIG. 8. is a close-up cross-sectional view of the conductive shell 20 and a screw 70 according to another embodiment of the present disclosure. In one embodiment of the present disclosure, the screw 70 has a front portion 70A having third threads 73A and a back portion 70B having second threads 73B, wherein the third threads 73A have a third pitch P3 substantially the same as the first pitch P1 of the first threads 23 of the conductive shell 20. In one embodiment of the present disclosure, the second threads 73B have a gradually changed pitch.

When the front portion 70A begins to engage with the screw hole 21, the screw 70 can be easily moved into the screw hole 21 of the conductive shell 20 because the third pitch P3 of the third thread 73A in the front portion 70A is substantially the same as the first pitch P1 of the first threads 23 of the conductive shell 20. After the front portion 70A is moved into the screw hole 21, the back portion 70B of the screw 70 starts to engage with the screw hole 21, and the screw 70 can be firmly fixed in the screw hole 21 by using the increasing pitch design of second threads 73B.

The resonant frequency of the microwave resonant cavity 10 can be adjusted by changing the extending position of the screw 30 into the volume 25, and the screw 30 can be firmly fixed in the screw hole 21 after the adjustment of the resonant frequency is completed due to the design of different pitches between the screw hole 21 and the screw 30. As a result, the resonant frequency of the microwave resonant cavity will be maintained at the desired value.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A microwave resonant cavity, comprising:

a conductive shell defining a volume, and the conductive shell including a screw hole having first threads; and a screw having second threads configured to engage with the screw hole, wherein the screw extends into the volume, wherein the microwave resonant cavity has a resonant frequency, and movement of the screw changes the resonant frequency;

wherein the first threads have a first pitch, and at least a portion of the second threads has a second pitch different from the first pitch, and wherein the screw has a front portion having third threads and a back portion having the second threads, and the third threads have a third pitch different from the second pitch.

2. The microwave resonant cavity of claim 1, wherein the second pitch is larger than the first pitch.

3. The microwave resonant cavity of claim 1, wherein the third pitch is substantially the same as the first pitch.

4. The microwave resonant cavity of claim 1, wherein the third pitch is substantially larger than the second pitch.

5. The microwave resonant cavity of claim 1, wherein the third pitch is substantially smaller than the second pitch.

6. The microwave resonant cavity of claim 1, wherein the conductive shell has a first hardness, and the screw has a second hardness greater than the first hardness.

7. The microwave resonant cavity of claim 1, wherein the screw includes a depression on one end to accommodate a tool for driving the screw.

8. The microwave resonant cavity of claim 1, further comprising a printed circuit board having a transmission line, wherein the conductive shell is mounted on the printed circuit board.

9. A microwave resonant cavity, comprising:

a conductive shell defining a volume, and the conductive shell including a screw hole having first threads; and a screw having second threads configured to engage with the screw hole, wherein the screw extends into the volume, wherein the microwave resonant cavity has a resonant frequency, and movement of the screw changes the resonant frequency;

wherein the first threads have a substantially constant pitch, and at least a portion of the second threads has a gradually changed pitch, and wherein the screw has a front portion having third threads and a back portion having the second threads, wherein a portion of the second threads without the gradually changed pitch has a second pitch, and the third threads have a third pitch different from the second pitch.

10. The microwave resonant cavity of claim 9, wherein the substantially constant pitch of the first threads have a first pitch, and the third pitch is substantially the same as the first pitch.

11. The microwave resonant cavity of claim 9, wherein the conductive shell has a first hardness, and the screw has a second hardness greater than the first hardness.

12. The microwave resonant cavity of claim 9, wherein the screw includes a depression on one end to accommodate a tool for driving the screw.

13. The microwave resonant cavity of claim 9, further comprising a printed circuit board having a transmission line, wherein the conductive shell is mounted on the printed circuit board.

14. A microwave resonant cavity, comprising:

a conductive shell defining a volume, and the conductive shell including a screw hole having first threads;

a screw having second threads configured to engage with the screw hole, wherein the screw extends into the volume; and a printed circuit board having a transmission line, wherein the conductive shell is mounted on the printed circuit board, wherein the microwave resonant cavity has a resonant frequency, and movement of the screw changes the resonant frequency, wherein the first threads have a substantially constant pitch, and at least a portion of the second threads has a gradually changed pitch, and wherein the conductive shell includes a notch configured to couple microwave energy.

* * * * *